US005456544A

United States Patent [19]

Aoki et al.

[11] Patent Number: 5,456,544

[45] Date of Patent: Oct. 10, 1995

[54] SHEET GUIDE FOR SMALL PRINTER

[75] Inventors: Takashi Aoki; Naoki Asai, both of Nagano, Japan

[73] Assignee: Seiko Epson Corporation, Tokyo, Japan

[21] Appl. No.: 83,496

[22] Filed: Jun. 28, 1993

[30] Foreign Application Priority Data

Jun. 26, 1992 [JP] Japan ..... 4-169323
May 18, 1993 [JP] Japan ..... 5-116125

[51] Int. Cl.[6] ..... B41J 13/18

[52] U.S. Cl. ..... 400/642; 400/645

[58] Field of Search ..... 400/642, 644, 400/645, 645.3, 645.4, 647, 647.1, 618

[56] References Cited

U.S. PATENT DOCUMENTS

| | | | |
|---|---|---|---|
| 415,535 | 11/1889 | Lassar | 400/642 |
| 442,028 | 12/1890 | Field | 400/645 |
| 2,748,916 | 1/1953 | Duke | 400/642 |
| 3,966,037 | 6/1976 | Zambolin | 400/618 |
| 4,483,635 | 11/1984 | Wisner et al. | 400/642 |
| 4,761,663 | 8/1988 | Piatt et al. | 400/647 |
| 4,773,782 | 9/1988 | Hirano | 400/637 |
| 5,026,185 | 6/1991 | Kusabuk | 400/618 |
| 5,067,705 | 11/1991 | Van Horne et al. | 400/618 |
| 5,090,677 | 2/1992 | Yamakoshi | 271/117 |

FOREIGN PATENT DOCUMENTS

| | | | |
|---|---|---|---|
| 0118318 | 9/1984 | European Pat. Off. | B41J 13/16 |
| 2384623 | 10/1978 | France | B41J 13/16 |
| 0209182 | 9/1986 | Japan | 400/647 |

*Primary Examiner*—Edgar S. Burr
*Assistant Examiner*—Anthony H. Nguyen
*Attorney, Agent, or Firm*—Sughrue, Mion, Zinn, Macpeak & Seas

[57] ABSTRACT

A sheet guide for a small printer whose record sheet inserting inlet opens when a record sheet is being inserted to the printer and closes to a minimal extent after the record sheet is being inserted so as to prevent foreign matter or the like from entering. In the event of trouble, such as jamming of sheets or entering of foreign matter, the sheet guide is easily removable to allow the cause of trouble to be eliminated. A sheet guide (inner) 67 is rotatably and releasably mounted on a shaft 12*a* of a sheet forward roller unit through elastically deforming engaging sections 67*c*, 67*d*.

4 Claims, 7 Drawing Sheets

SHEET GUIDE FOR SMALL PRINTER

BACKGROUND OF THE INVENTION

1. Field of the Invention

The invention relates to a sheet guide for a small printer.

2. Description of the Related Art

As shown in FIGS. 11 and 12, conventional sheet guide mechanisms are characterized as fixing a record sheet inserting section and a sheet guide passage forming member contiguous thereto on the frame of a printer in order to provide a gap for the passage of the record sheet. An example shown in FIG. 11 is designed to fix a sheet guide (inner) 125 and a sheet guide (outer) 126 by engaging their mounting sections 125*a*, 125*b*, 126*a* and 126*b* with frames 120, 121 of the printer with caulking or the like. An example shown in FIG. 12 is constructed so that the frame 131 itself serves as a sheet guide (outer) component. A sheet guide (inner) 135 is fixed on the frame 131 with sheet guide holding screws 138. Therefore, the gap for the passage of a record sheet is invariable in the conventional examples.

These conventional examples reveal the following problems. Since the record sheet inserting inlet and the sheet guide passage forming member are either fixed on the frame, etc. or part of the frame itself, an attempt to increase the opening of the inserting inlet for a better insertion of the record sheet leaves a large gap at all times. This causes jamming at the sheet guide passage because such large gap allows sheets and foreign matter to enter therefrom.

In the case of a rolled record sheet such as a pressure-sensitive copying sheet, printing is done by inserting a plurality of rolled sheets with their ends flush. Since the inner diameter of the roll is different from the outer diameter by the thickness of the sheet, the inner record sheet is shorter than the outer record sheet. As a result, even if neither sheet is slack at the time of insertion, the record sheets other than the innermost one become gradually loose between the record sheet inserting inlet of the printer and the roll, because it is the innermost record sheet having the shortest circumference that pulls and rotates the roll to unwind the roll of record sheets. The slack of the record sheets becomes easier to be threaded into the record sheet inserting inlet while tucked and folded as the opening of the record sheet inserting inlet becomes wider. Once the record sheets have been threaded while folded, their thickness doubles, thereby causing the record sheets to jam along the sheet guide passage.

In the case of such jamming of sheets and clogging of foreign matter, the record sheets or foreign matter blocking the sheet guide passage must be eliminated to restore normal passage of sheets. The conventional structure in which the record sheet inserting inlet and the sheet guide passage forming member are fixed on the frame or the like is disadvantageous in eliminating such record sheets or foreign matter once the record sheets or foreign matter have been caught in the depth of the narrow and bent sheet guide passage.

SUMMARY OF THE INVENTION

The invention has been made to overcome these shortcomings. Accordingly, an object of the invention is to provide a sheet guide mechanism for a small printer which ensures excellent record sheet inserting performance and which is capable of blocking the entrance of foreign matter or the like at times other than setting the record sheets as well as removing the foreign matter or record sheets when the foreign matter has entered or the record sheets have been jammed.

The invention is applied to a sheet guide mechanism for a small printer having a sheet guide (inner) and a sheet guide (outer) for forming a record sheet inserting inlet of the small printer and a sheet guide passage thereof contiguous to the record sheet inserting inlet. In such a sheet guide mechanism, at least one of the sheet guides (inner) and (outer) is mounted on the printer body so that the sheet guide turns to open the record sheet inserting inlet.

Further, in the sheet guide mechanism for a small printer according to the invention, the printer body has a holding section and the rotatable sheet guide (inner) or (outer) has an engaging section to be engaged with the holding section by elastic deformation.

According to the invention, at least one of the sheet guide (inner) and the sheet guide (outer) is turned to open the record sheet inserting inlet widely when a record sheet is being inserted and to close the record sheet inserting inlet when the record sheet is not being inserted. When foreign matter or the like has entered, at least one of the sheet guides (inner) and (outer) is readily removable so that such foreign matter or the like can be eliminated easily.

DESCRIPTION OF THE PREFERRED EMBODIMENTS

Figure 1:
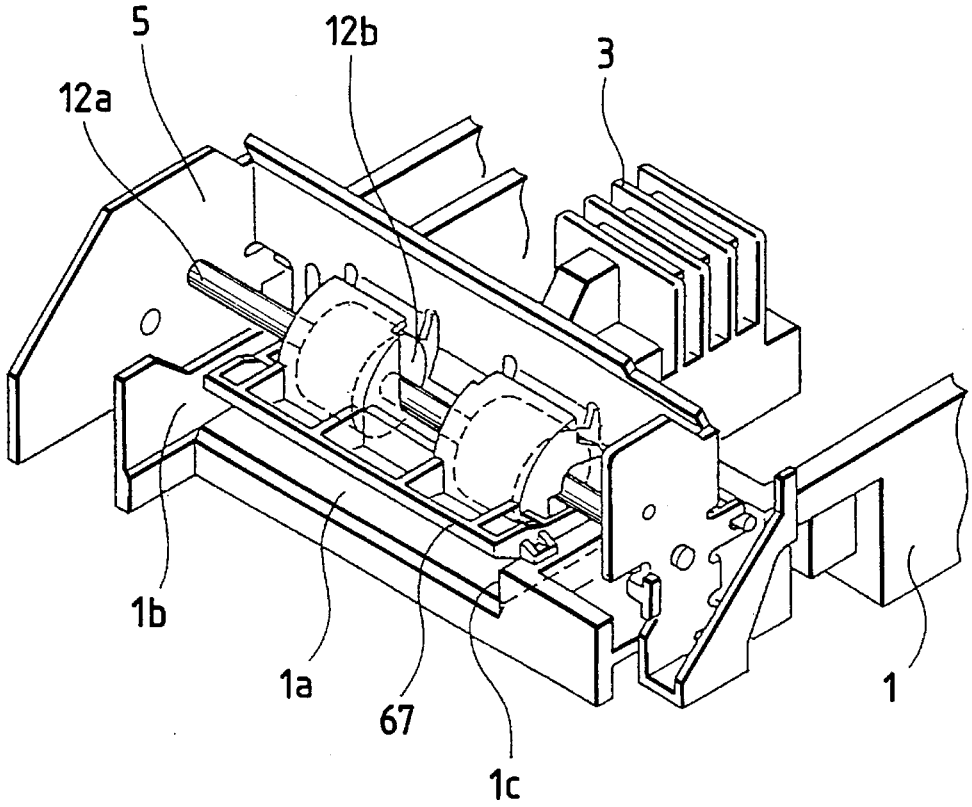
FIG. 1 is a perspective view of a record sheet inserting section, which is an embodiment of the invention.

The present invention will now be described with reference to the accompanying drawings.

FIGS. 6 to 10 show a rough structure of the frame of a printer according to the invention. This printer is designed to print on a rolled record sheet 10 that is held thereon. The printer includes: a roll holder 11; a monolithically formed resin-made base frame 1; a main guide shaft 2 arranged inside the base frame 1; a print head 3 moving along the main guide shaft 2; a platen frame 5 mounted on the base frame 1 so as to confront the main guide shaft 2; and a print ribbon 4, interposed between the print head 3 and the record sheet 10 for supplying ink at the time the print head prints dots on the record sheet. The printer of the invention also includes a ribbon cassette 7 containing the print ribbon 4. The cassette 7 is arranged on the base frame 1.

The rolled record sheet 10 held on the holder 11 projecting toward the inside of the base frame 1 is rewound and guided between the platen frame 5 and the print ribbon 4 by sheet forward rollers 12 and a sheet biasing roller 8 that cooperates therewith. The sheet forward rollers 12 are mounted in parallel with the main guide shaft 2. The feed motor 13 mounted on the platen frame 5 drives the sheet forward rollers 12 through a gear train 14. Dot-matrix printing is made by the print head 3 on the record sheet 10 guided between the platen frame 5 and the print ribbon 4 based on an externally applied character signal. The print head 3 is mounted so as to slide along the main guide shaft 2. The print head 3 is connected to a head drive motor 15 through a drive belt 16 that has continuously formed projections, so that the print head 3 can take various positions along the main guide shaft 2 in accordance with the amount of rotation of the head drive motor 15.

Figure 10:
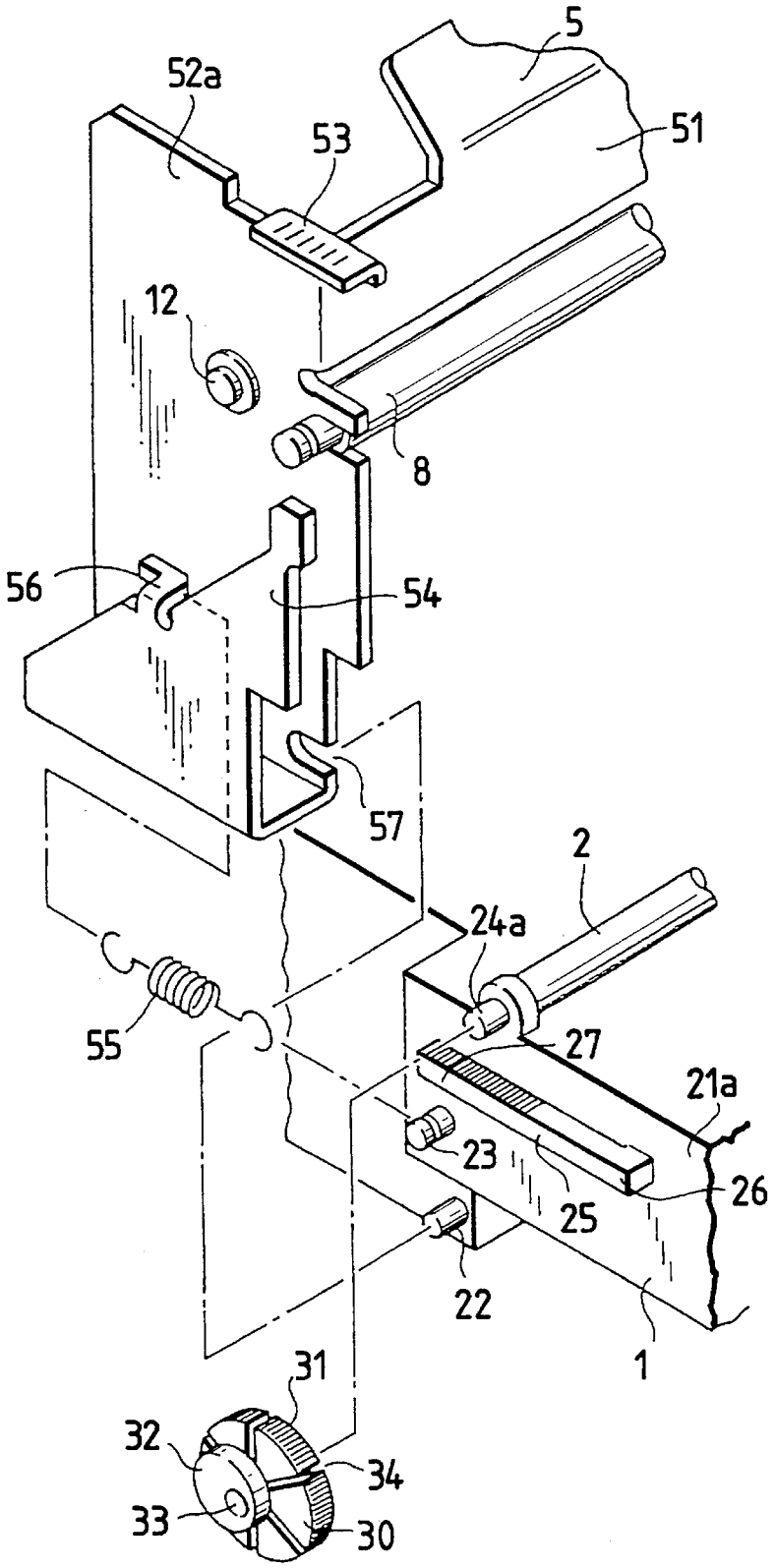
FIG. 10 is a detailed exploded view of a platen frame mounting section of the printer shown in FIG. 6.
Figure 11:
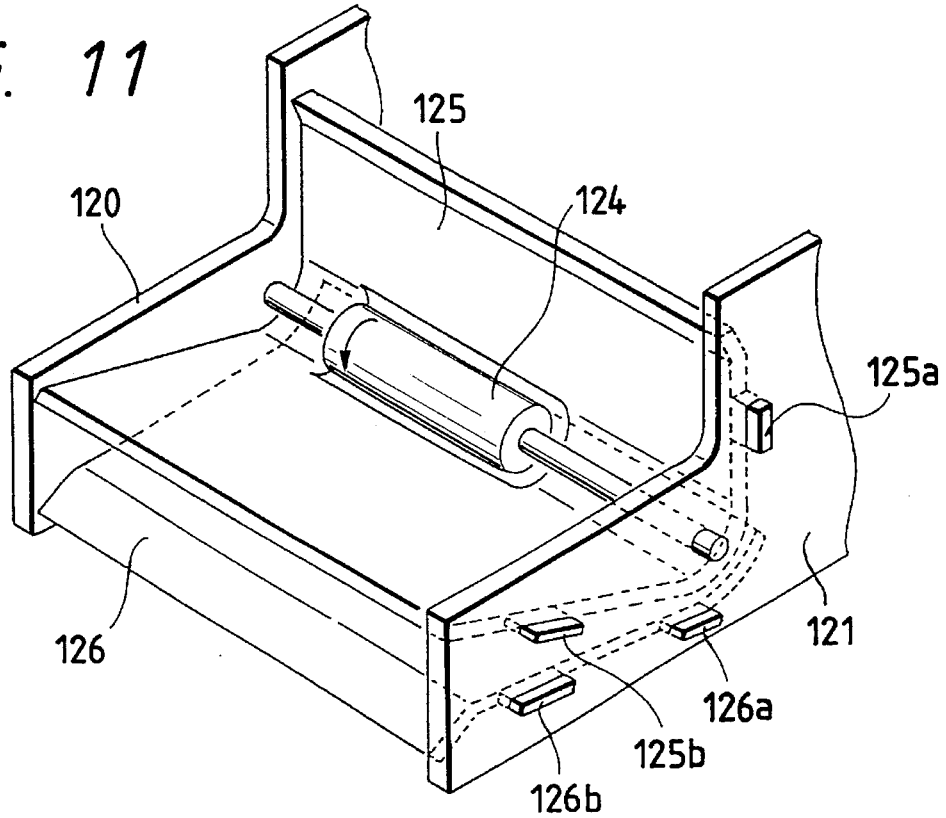
FIG. 11 is a perspective view of a record sheet inserting section of a conventional example.
Figure 12:
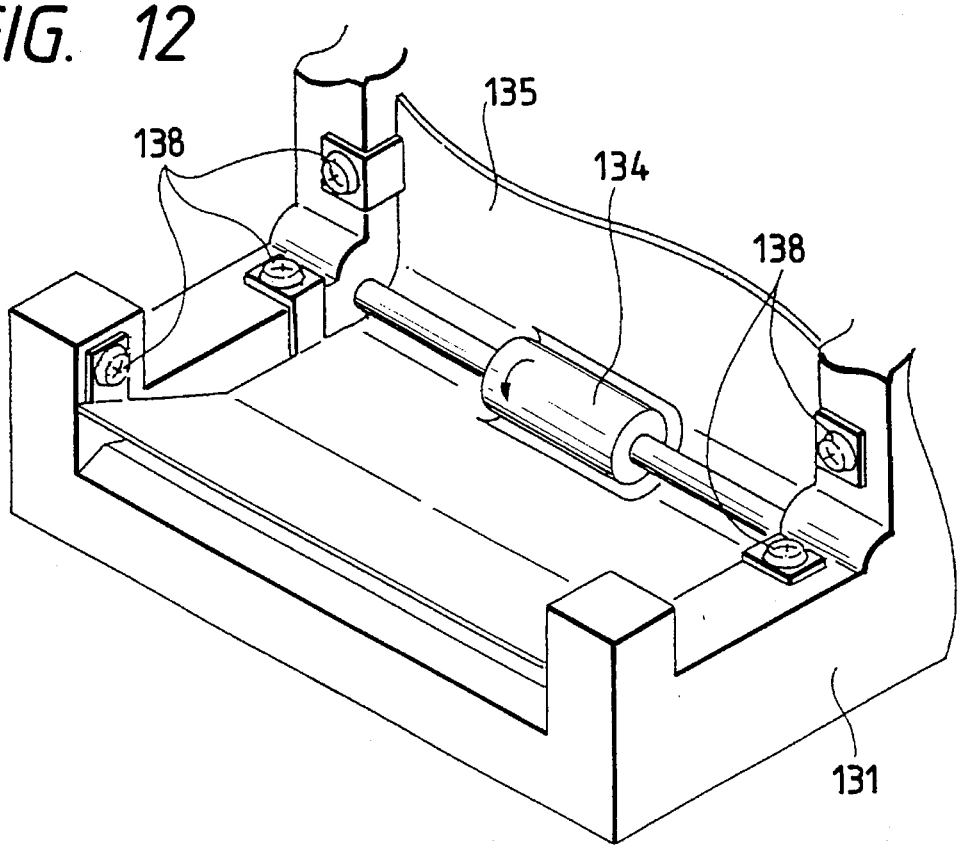
FIG. 12 is a perspective view of a record sheet inserting section of another conventional example.

FIG. 10 shows the platen frame 5 and a connecting section D of the base frame 1 in exploded form. The platen frame 5 is a plate-like member 51 designed to guide the record sheet 10 in parallel with the main guide shaft 2 and is made of a rigid metal. On both ends of the plate-like member 51 are connecting surfaces 52*a*, 52*b* that are bent substantially at right angles so that the plate-like member 51 can be mounted along the side surfaces 21*a*, 21*b* of the base frame 1. These connecting surfaces 52*a*, 52*b* have gap gauges 53 projecting from the plate-like member 51 toward the main guide shaft 2. Graduations are provided on each gap gauge 53 so that the gap between the plate-like member 51 and the end of the print head 3 can be checked with ease. Further, outside the connecting surfaces 52*a*, 52*b*, i.e., outside the plate-like member 51 are gap members 54, which is a substantially rectangular solid member for regulating the gap relative to the main guide shaft 2. Each gap member 54 is formed in such a manner as to project toward the main guide shaft 2. The platen frame 5 has the projections 56 for mounting rocking springs 55 that are used to press the platen frame 5 against the base frame 1. The platen frame 5 also has mounting recesses 57, so that the platen frame 5 can rotate and move in parallel to the base frame 1 at the mounting section thereof. The connecting surfaces 52*a*, 52*b* interpose the sheet forward rollers 12 so as to be rotatable, the sheet forward rollers 12 being driven by the feed motor 13.

The side surfaces 21*a*, 21*b* of the resin-made base frame 1 to be mounted on the connecting surfaces 52*a*, 52*b* of the platen frame 5 have connecting projections 22 so that the side surfaces 21*a*, 21*b* can be engaged with the platen frame mounting recesses 57. The base frame 1 further has spring mounting projections 23 so that ends of the rocking springs 55 can be attached thereto. The projections 23 confront the projections 56 arranged on the platen frame 5 for mounting the other ends of the rocking springs 55. On ends 24*a*, 24*b* of the main guide shaft 2 projecting from the side surfaces 21*a*, 21*b* of the base frame 1 are disc-like gap adjusting members 30.

Each gap adjusting member 30 includes: a circumferentially indented fixed disc 31; and an adjusting disc 32 whose diameter is smaller than the fixed disc 31. The disc 32 is fixed on the disc 31. The central axis of the adjusting disc 32 is eccentric relative to that of the fixed disc 31. Each mounting hole 33 for mounting the discs on each of the ends 24*a*, 24*b* of the main guide shaft 2 is formed at the central axis of the fixed disc 31. Each fixed disc 31 has notches every predetermined angle to allow a tool to be inserted when the gap adjusting member 30 is rotated. Substantially rectangular solid fixed members 25 project from the side surfaces 21*a*, 21*b* of the base frame 1 so that the fixed members 25 come in contact with the fixed discs 31 on their outer circumferential portions when the gap adjusting members 30 are mounted on the ends 24*a*, 24*b* of the main guide shaft 2, respectively. One end 26 of each fixed member is fixed on each of the side surfaces 21*a*, 21*b* of the base frame 1, whereas the other end thereof 27 is left free, and a portion that is in contact with the fixed disc 31 is indented. With a ratchet mechanism formed by biasing the outer circumference of the fixed disc 31 onto the end 27 of the fixed member 25 and by engaging the indentations formed on the end 27 with the indentations formed on the outer circumference of the fixed disc 31, the gap adjusting member 30 can be fixed at various angles.

As a result of this construction, the platen frame 5 is mounted on the base frame 1 so that the platen frame mounting recesses 57 of the platen 5 can be engaged with the mounting projections 22 of the base frame 1. Since each platen frame mounting recess 57 has a diameter slightly larger than the projection 22 and has an opening on one end, the platen frame 5 is mounted on the base frame 1 so as to be rotatable and slightly movable in parallel. The platen frame 5 is pulled toward the main guide shaft 2 by each spring mounting projection 56 of the platen frame 5 and each rocking spring 55 mounted on the spring mounting projection 23 of the base frame 1. Each gap member 54 fixed on the platen frame 5 is formed so that one end thereof comes in contact with the adjusting disc 32 of the gap adjusting member 30. Therefore, the gap member 54, while biased onto the adjusting disc 32 by the rocking spring 55, provides a certain distance between the platen frame 5 and the main guide shaft 2.

Since the eccentric gap adjusting member 30 can adjust a platen gap W, any distortion of the resin-made base frame 1 caused during manufacture can be rectified easily. The gap adjusting member 30 can, of course, adjust the platen gap W to the thickness of the record sheet 10.

Figure 9:
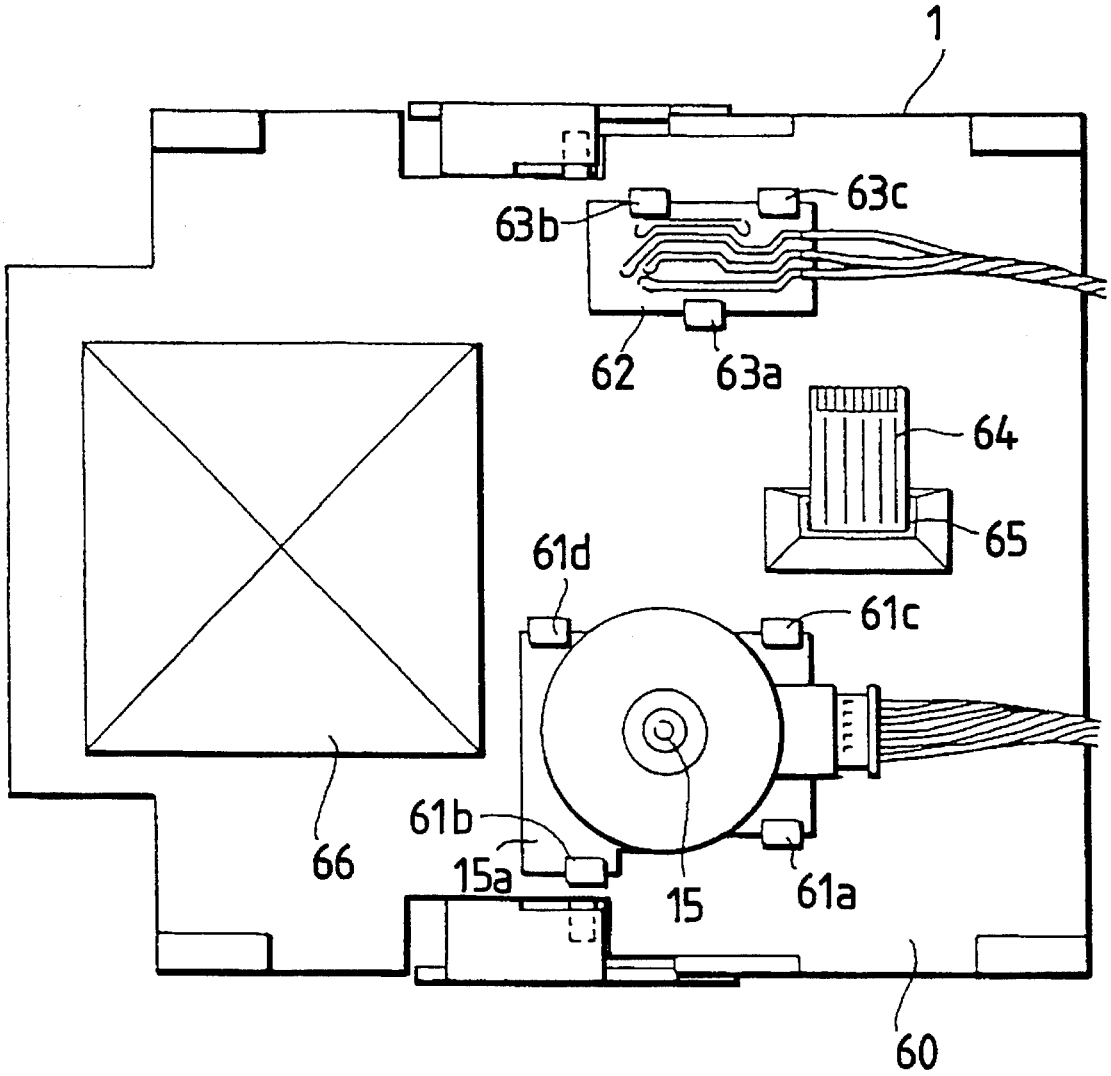
FIG. 9 is a bottom view of the printer shown in FIG. 6.

Let us take a close look at a bottom 60 of the base frame 1 shown in FIG. 9. The bottom 60 has catches 61*a* to 61*d* to mount the head drive motor 15 thereon. A board 15*a* of the motor 15 is inserted sideways into the catches 61*a* to 61*d*, so that the motor 15 is mounted on the base frame 1. These catches 61*a* to 61*d* are formed integrally with the resin-made base frame 1. The catches may take various forms in accordance with components to be mounted. Like the motor 15, a printed board 62 can be fixed on the base frame 1 using catches 63*a* to 63*c*.

Since the resin-made base frame 1 can readily be formed, a through-hole 65 for inserting the flexible printed wiring board 64 from the print head 3 may be tapered. The tapering of the through-hole 65 contributes to preventing breakage of the printed wiring 64 due to the wiring being bent at acute angles. Below the holder 11 arranged on the base frame 1 is a space 66 for mounting a printer controlling printed circuit board.

In this example, the rocking spring 55 is a tensile spring, which pulls the platen frame 5 toward the main guide shaft 2 to bias the gap member 54 onto the gap adjusting member 30. As a result, the platen gap can be ensured. In place of tensile springs, compression springs may be used as the rocking spring 55 on condition that the gap member 54 connecting position is changed.

An exemplary sheet guide of the invention mounted on the thus constructed printer will be described in detail with reference to FIGS. 1 to 4.

Figure 2:
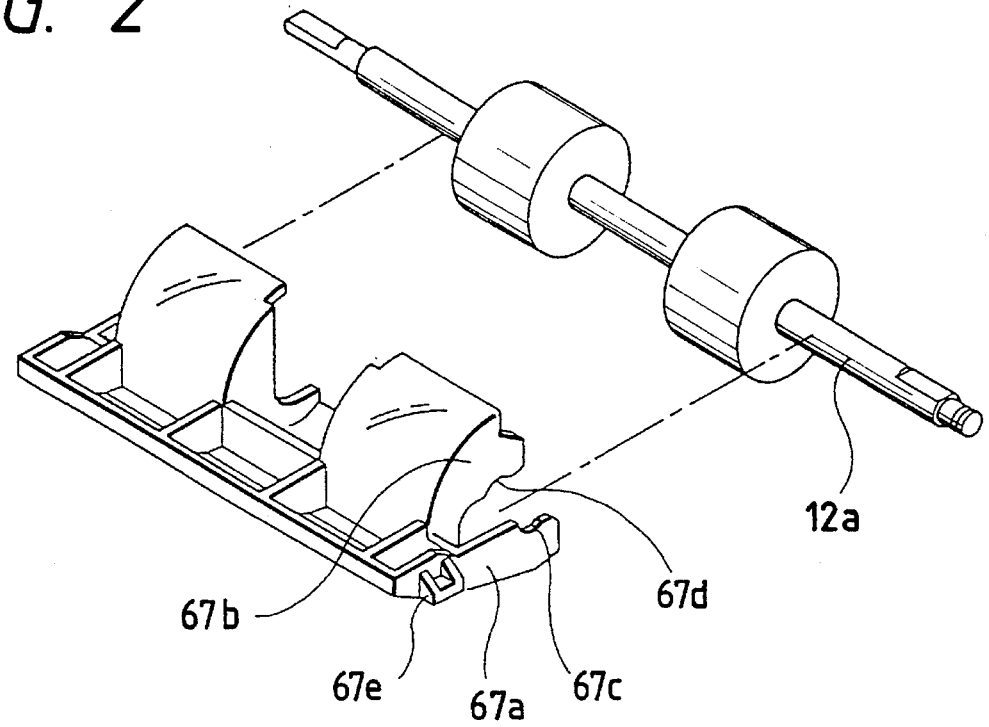
FIG. 2 is a detailed view of an engaging section between a sheet forward roller unit and a sheet guide (inner)
Figure 3:
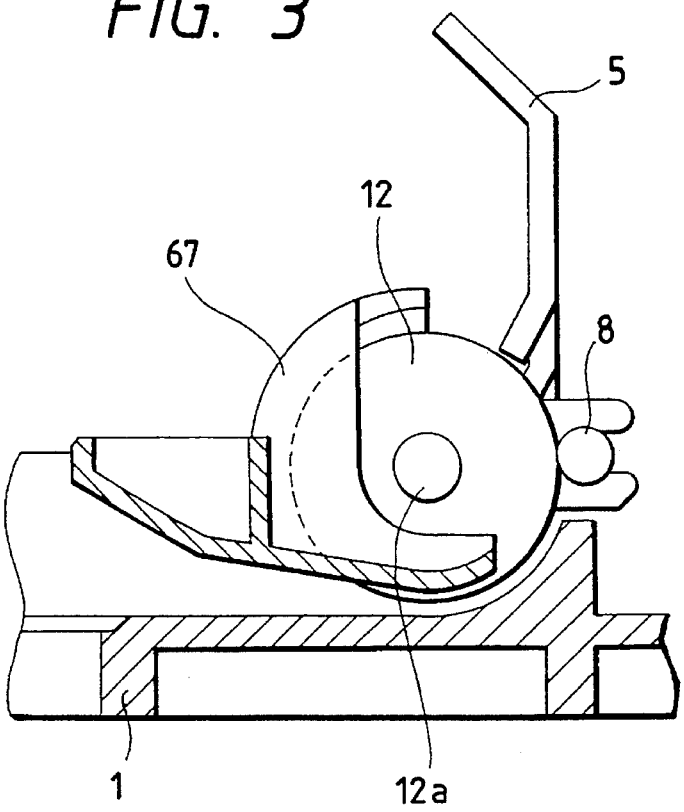
FIG. 3 is a detailed partial sectional view of the record sheet inserting section after the record sheet is being inserted.
Figure 4:
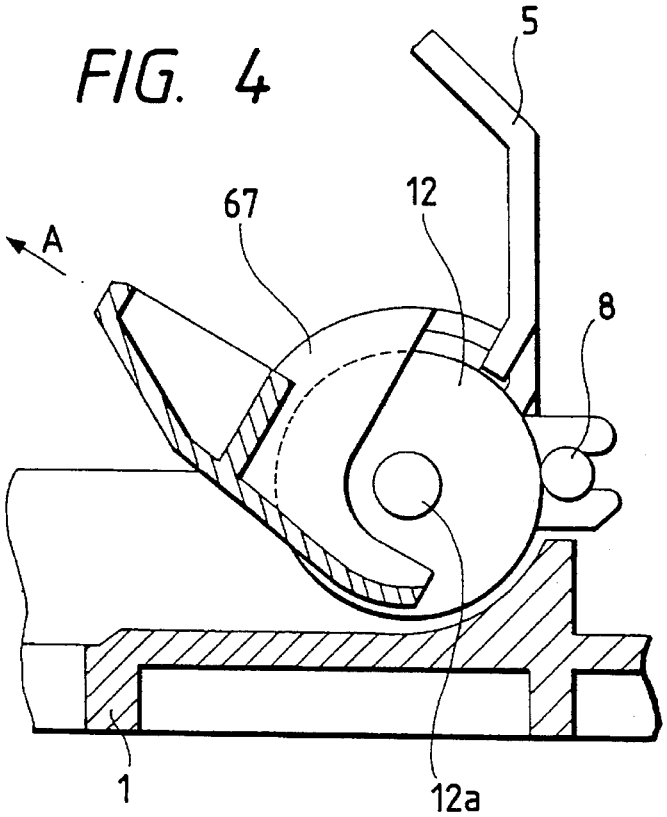
FIG. 4 is a detailed partial sectional view of the record sheet inserting section while the record sheet is being inserted.

FIG. 1 is a perspective view of a record sheet inserting section in this embodiment; FIG. 2 is a detailed view of an engaging section between a sheet forward roller unit and a sheet guide (inner); FIG. 3 is a sectional view of the record sheet inserting section during normal operation; and FIG. 4 is a sectional view of the record sheet inserting section when a record sheet is being inserted. The record sheet is not shown in FIGS. 3 and 4.

In FIG. 1, the base frame 1 holding the platen frame 5 and the print head 3 provides a surface 1*a* having the role of a sheet guide (outer) and surfaces 1*b*, 1*c* having the role of sheet guide walls for guiding both the right and left sides of the record sheet. The platen frame 5 mounted on the base frame 1 holds the sheet forward roller unit 12. A shaft 12*a* of the sheet forward roller unit 12 is inserted into the platen frame 5, so that the shaft 12*a* is rotatable at the inserted positions. The sheet forward roller unit 12 has fixed rollers 12*b* for sheet feeding. The rollers 12*b* rotate together with the shaft 12*a* to thereby feed the record sheet by frictional force. As shown in FIG. 2, a sheet guide (inner) 67 made of plastic is mounted in such a manner that both ends of the shaft 12*a* of the sheet forward roller unit 12 are interposed between recesses 67*c* arranged on arms 67*a* and recesses 67*d* arranged on the roller covers 67*b*, respectively. Since the size of the opening formed by an end of the arm 67*a* and an end of the roller cover 67*d* is made smaller than the diameter of the shaft 12*a*, the arm 67*a* and the roller cover 67*d* are caused to deform elastically when the sheet guide (inner) is mounted on or removed from the shaft 12*a*.

The sheet forward roller unit 12 of the embodiment has two rollers 12*b*. The sheet guide (inner) 67 is mounted at two positions using the arms 67*a* and the roller covers 67*b* in such a manner as to interpose these two sheet forward rollers 12*b*. Since the diameter of the arcs including the recesses 67*c*, 67*d* of the sheet guide (inner) 67 is made slightly larger than the diameter of the shaft 12*a* of the sheet forward roller unit 12, a gap is provided between the recesses 67*c*, 67*d* and the shaft 12*a* with the sheet guide (inner) 67 being mounted. This prevents the sheet guide (inner) 67 from rotating even if the sheet forward roller unit 12 is being operated, and further allows the sheet guide (inner) 67 to turn without causing the shaft 12*a* of the sheet forward roller unit 12 to rotate.

The sheet bias roller 8 (FIG. 3) is biased onto the rollers 12*b* of the sheet forward roller unit 12, so that the record sheet having passed through a sheet forward passage including the sheet guide surfaces 1*a*, 1*b*, 1*c* and the sheet guide (inner) 67 of the base frame 1 is forwarded by the operation of the sheet forward roller unit 12 while nipped between the rollers 12*a* of the sheet forward roller unit 12 and the sheet bias roller 8.

In the thus constructed sheet guide mechanism, the sheet guide (inner) 67 takes a stand-by position keeping a gap for the passage of the record sheet at such a position shown in FIG. 3 with graduating sections 67*e* thereof abutting on the base frame 1 when no record sheet is being inserted. However, at the time the record sheet is being inserted, the sheet guide (inner) 67 is turned around the shaft 12*a* of the sheet forward roller unit 12 until the sheet guide 67 abuts on the platen frame 5 either automatically or manually as shown in FIG. 4. As a result, the record sheet inserting inlet gets opened widely.

Figure 5:
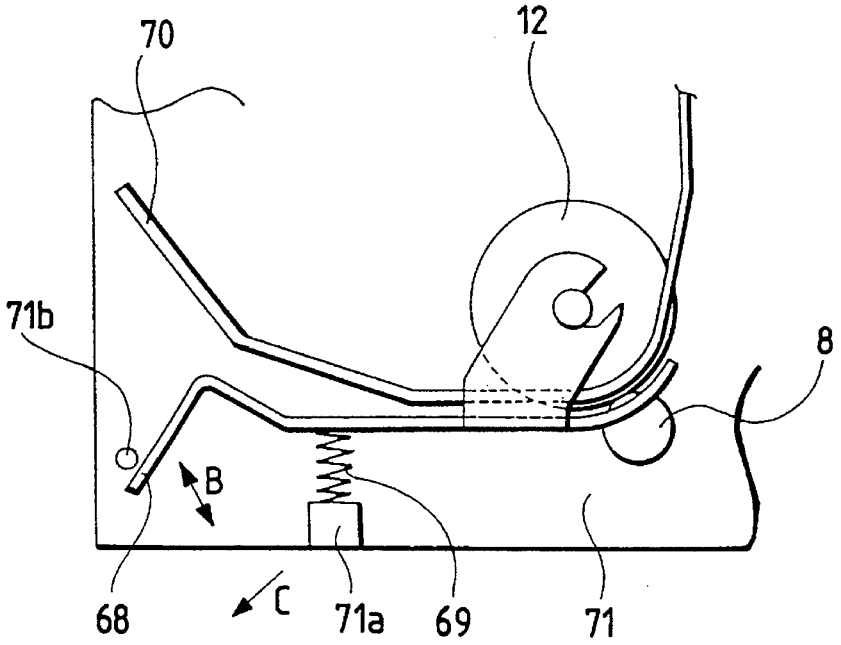
FIG. 5 is a detailed view of a record sheet inserting section, which is another embodiment of the invention.
Figure 6:
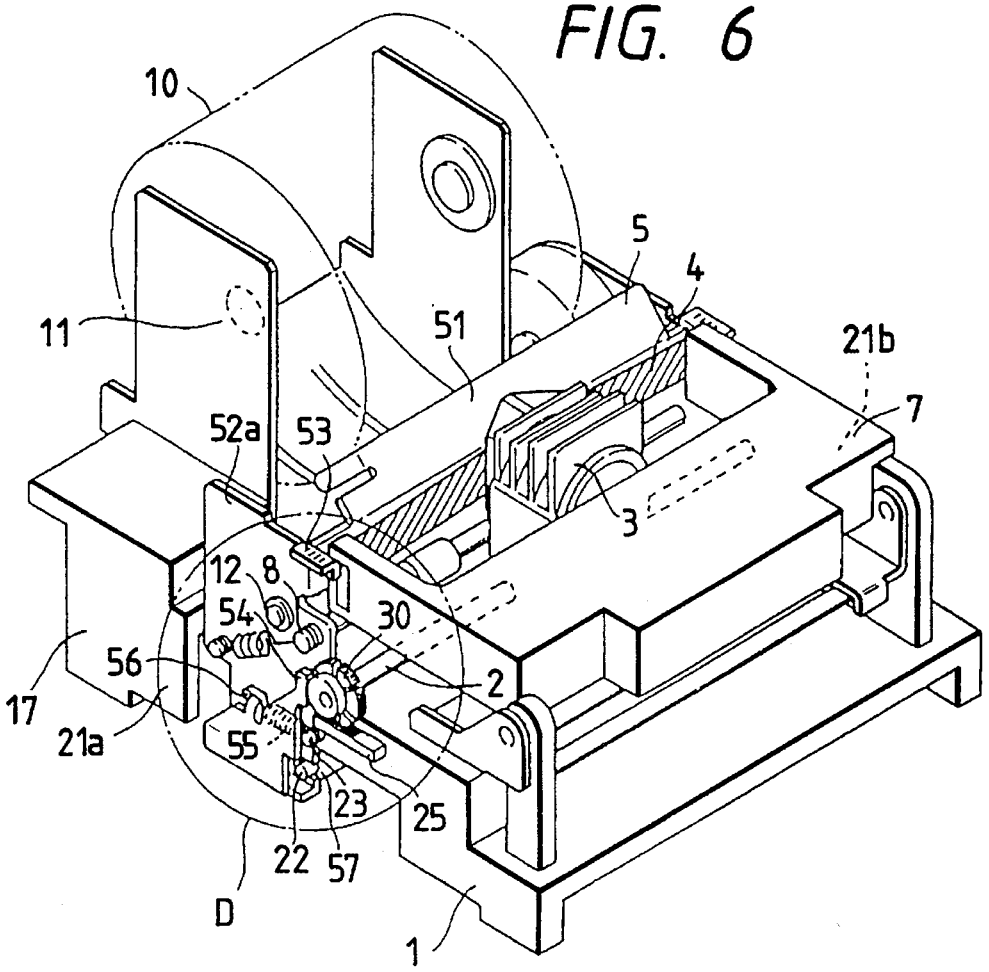
FIG. 6 is a perspective view showing a rough configuration of a printer according to the invention.
Figure 7:
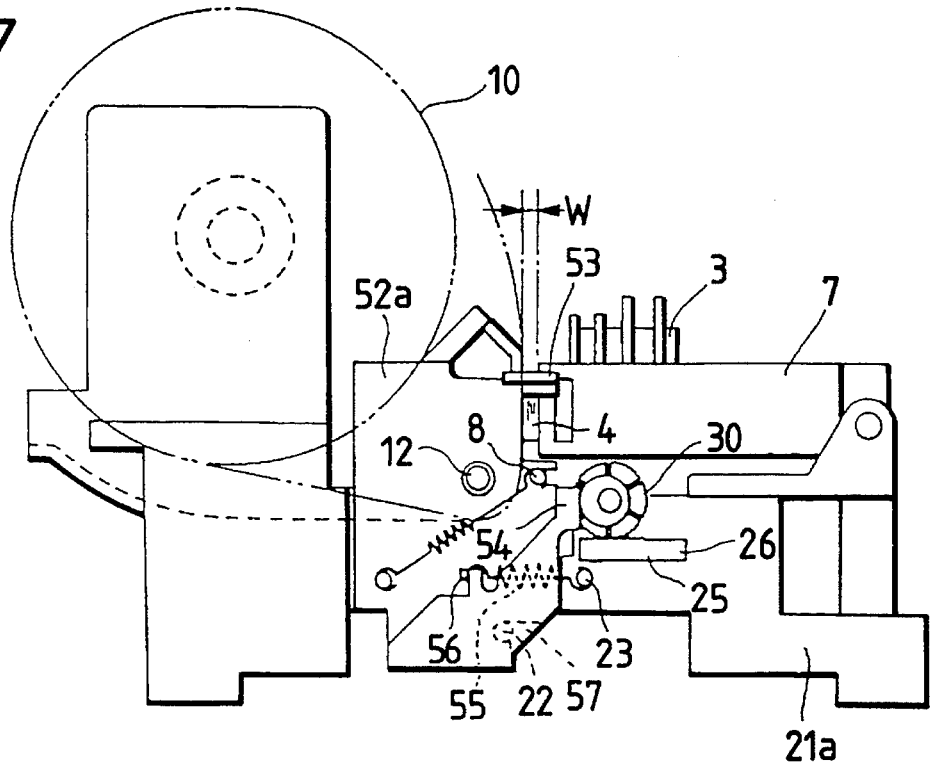
FIG. 7 is a side view of the printer shown in FIG. 6.
Figure 8:
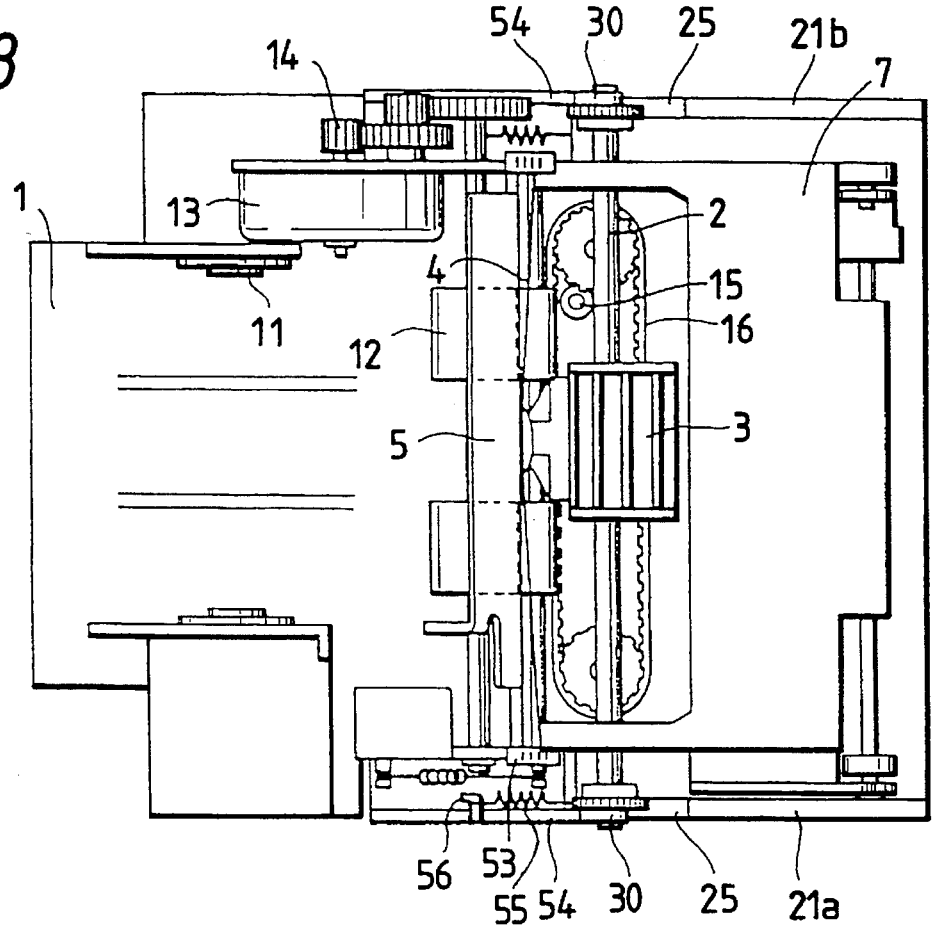
FIG. 8 is a plan view of the printer shown in FIG. 6.

While the sheet guide (inner) 67 of this embodiment is designed to turn to widely open the record sheet inserting inlet, as another embodiment shown in FIG. 5, a sheet guide (outer) 68 may be arranged to turn in a direction indicated by an arrow B. The inserting inlet can also be opened by movement other than rotation of the sheet guide. If the sheet guide (outer) 68 is biased so as to close the inserting inlet using a spring member such as a sheet guide holding spring 69 shown in FIG. 5, the sheet guide 68 is given the function of a tension lever for unwinding the rolled record sheet during printing.

The terms (inner) and (outer) herein used are indented to mean the directions in which the record sheet in the sheet guide passage is bent by being wrapped around the sheet forward rollers. If the record sheet is not bent as it is forwarded along the sheet guide passage, terms (upper) and (lower) may be used. The sheet guide (inner) 67 is engaged with the shaft 12*a* of the sheet forward roller unit 12 by utilizing elastic deformation of the arms 67*a* and the roller covers 67*b*. Thus, by pulling away the sheet guide (inner) 67 in a direction indicated by an arrow A shown in FIG. 4, the sheet guide (inner) 67 can be removed easily. As described before, once the sheet guide (inner) 67 has been removed, the sheet guide passage can be viewed directly, and this facilitates the elimination of record sheets or foreign matter which have jammed or blocked the passage. In the case of FIG. 5, the sheet guide (outer) 68 can similarly be pulled away in a direction indicated by an arrow C, so that the sheet guide 68 can be taken out.

As described in the foregoing pages, the invention is characterized as allowing record sheets to be inserted easily by turning the sheet guide (inner) 67 around the shaft 12*a* of the sheet forward roller unit 12 and thereby opening the record sheet inserting inlet when the record sheet is being inserted. After the record sheet is inserted, the sheet guide (inner) 67 is turned back to a predetermined position to close the record sheet inserting inlet, thereby preventing the jamming of record sheets caused by the entering of either foreign matter or the slack of rolled record sheets such as rolled pressure-sensitive copying paper.

Further, the printer according to the invention is designed so that the sheet guide (inner) 67 is easily releasable from the printer body. As a result, in the event of a jam, the sheet guide can be removed easily to allow the sheet guide passage to be inspected to eliminate the cause of trouble.

What is claimed is:

1. A sheet guide for a small printer comprising:

a printer body;

an inner sheet guide and an outer sheet guide, said inner and outer sheet guides defining an entrance end and an opposite end, and said inner and outer sheet guides forming a record sheet inserting inlet at said entrance end thereof and defining a sheet guide passage communicating with the printer body and terminating at said opposite end of said sheet guides, at least one of the inner and outer sheet guides being pivotally mounted on the printer body adjacent said opposite end;

means for allowing the pivotally mounted sheet guide to pivot in a first direction so as to enlarge the record sheet inserting inlet to a first size for insertion of a record sheet; and means for allowing the pivotally mounted sheet guide to pivot in a second direction so as to reduce the record sheet inserting inlet to a second size narrow enough to guide the record sheet to the printer during operation of the printer, the first size being larger than the second size.

2. A sheet guide for a small printer comprising:

a printer body;

an inner sheet guide and an outer sheet guide, the inner and outer sheet guides forming a record sheet inserting inlet, at least one of the inner and outer sheet guides being pivotally mounted on the printer body;

a sheet guide passage contiguous to the record sheet inserting inlet;

means for allowing the pivotally mounted sheet guide to pivot in a first direction so as to enlarge the record sheet inserting inlet to a first size for insertion of a record sheet;

means for allowing the pivotally mounted sheet guide to pivot in a second direction so as to reduce the record sheet inserting inlet to a second size narrow enough to guide the record sheet to the printer during operation of the printer, the first size being larger than the second size; and means for releasably mounting at least one of the inner and outer sheet guides on the printer body by causing a mounting section of the sheet guide to be deformed elastically.

3. A sheet guide for a small printer, comprising:

a printer body;

an inner sheet guide and an outer sheet guide, the inner and outer sheet guides forming a record sheet inserting inlet, at least one of the inner and outer sheet guides being pivotally mounted on the printer body;

a sheet guide passage contiguous to the record sheet inserting inlet;

means for allowing the pivotally mounted sheet guide to pivot in a first direction so as to enlarge the record sheet inserting inlet to a first size for insertion of a record sheet; and means for allowing the pivotally mounted sheet guide to pivot in a second direction so as to reduce the record sheet inserting inlet to a second size narrow enough to guide the record sheet to the printer during operation of the printer, the first size being larger than the second size, wherein the printer body has a holding section and at least one of the inner and outer sheet guides is rotatable and has an engaging section including means for engaging the sheet guide with the holding section by elastic deformation.

4. A sheet guide for a small printer according to claim 2, wherein the printer body has a holding section and at least one of the inner and outer sheet guides is rotatable and has an engaging section including means for engaging the sheet guide with the holding section by elastic deformation.

* * * * *